US008654813B2

(12) United States Patent
Schubert

(10) Patent No.: US 8,654,813 B2
(45) Date of Patent: Feb. 18, 2014

(54) SAFETY DEVICE FOR DETECTING ELECTRODE BREAKAGE

(75) Inventor: Manfred Schubert, Oberhausen (DE)

(73) Assignee: SMS Demag AG, Duesseldorf (DE)

( * ) Notice: Subject to any disclaimer, the term of this patent is extended or adjusted under 35 U.S.C. 154(b) by 1642 days.

(21) Appl. No.: 11/793,408

(22) PCT Filed: Dec. 16, 2005

(86) PCT No.: PCT/EP2005/013573
§ 371 (c)(1),
(2), (4) Date: Feb. 22, 2008

(87) PCT Pub. No.: WO2006/066817
PCT Pub. Date: Jun. 29, 2006

(65) Prior Publication Data

US 2008/0304538 A1 Dec. 11, 2008

(30) Foreign Application Priority Data

Dec. 17, 2004 (DE) ..... 10 2004 060 826

(51) Int. Cl.
*H05B 7/12* (2006.01)
*H05B 7/10* (2006.01)
*H05B 7/102* (2006.01)

(52) U.S. Cl.
USPC ..... 373/96; 373/69; 373/94

(58) Field of Classification Search
USPC ..... 373/96, 88, 92, 94, 106, 69, 81, 100, 373/103; 73/708
See application file for complete search history.

(56) References Cited

U.S. PATENT DOCUMENTS

| | | | | |
|---|---|---|---|---|
| 2,386,260 | A * | 10/1945 | Payne | 373/99 |
| 4,287,381 | A | 9/1981 | Montgomery et al. | |
| 4,357,485 | A | 11/1982 | Lamarque et al. | |
| 4,434,496 | A * | 2/1984 | Krogsrud | 373/96 |
| 4,852,120 | A * | 7/1989 | Udo | 373/95 |
| 5,709,835 | A | 1/1998 | Meewissen et al. | |
| 6,214,286 | B1 * | 4/2001 | Larsen et al. | 266/241 |
| 2009/0050757 | A1 | 3/2006 | Sidorski | |

OTHER PUBLICATIONS

Patent abstract of Japan JP-52007046, Jan. 1977.

* cited by examiner

*Primary Examiner* — Henry Yuen
*Assistant Examiner* — Hung D Nguyen
(74) *Attorney, Agent, or Firm* — Abelman, Frayne & Schwab

(57) ABSTRACT

The invention relates to a safety device (1) for detecting electrode breakage in an electric arc furnace, wherein an electrode (6) is secured on an electrode support arm (4), and wherein a conduit is filled with a medium under a constant pressure and a pressure drop is produced at an electrode breakage, which is detected as an alarm signal. Here, the conduit (7*a-d*,3) is integrated in a protective component that is arranged beneath the electrode support arm (4) thereon, wherein in case of an electrode breakage, the conduit (7*a-d*,3) is damaged by a produce electric arc and the pressure drop takes place.

7 Claims, 3 Drawing Sheets

SAFETY DEVICE FOR DETECTING ELECTRODE BREAKAGE

Figure 1:
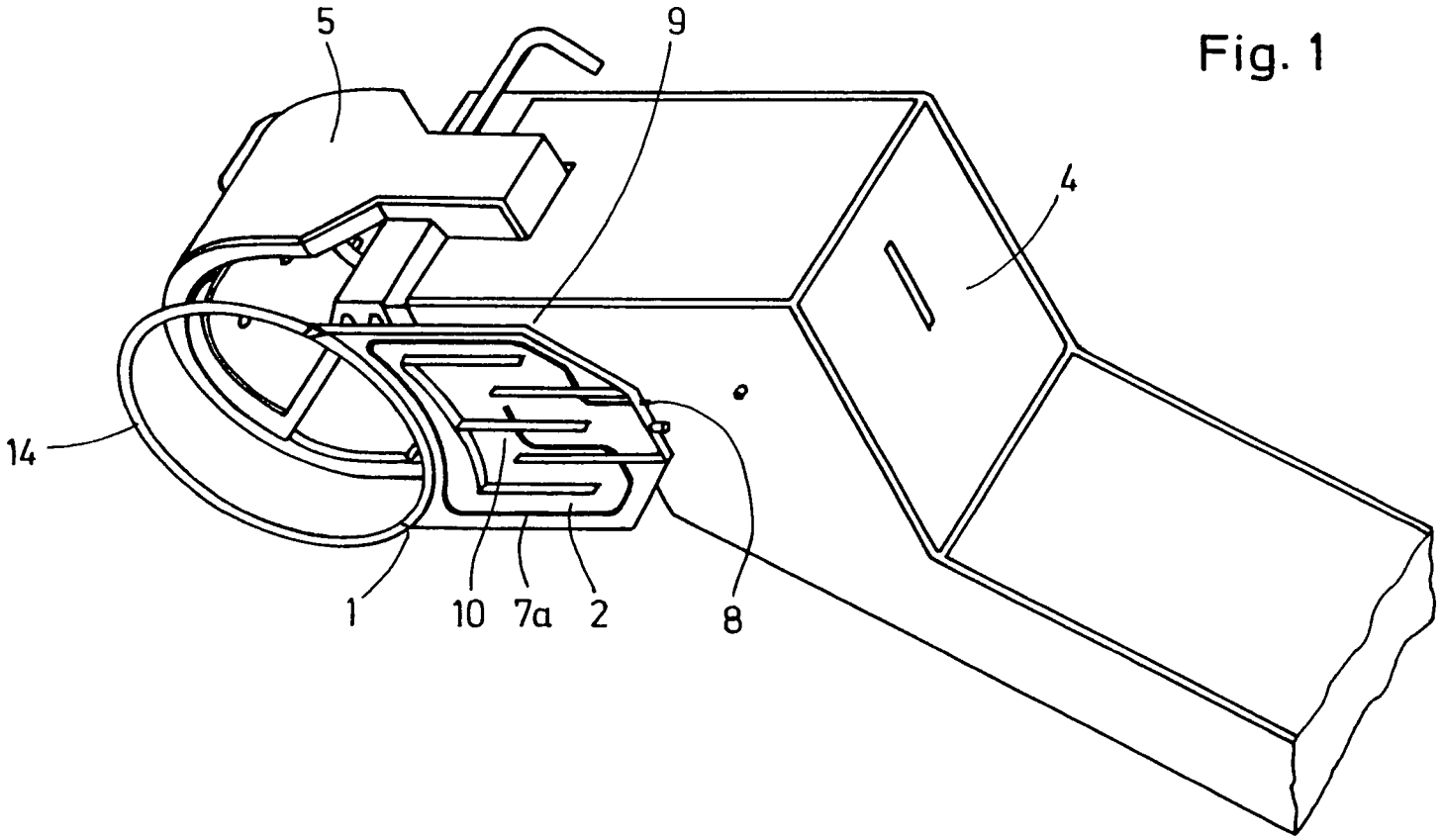

The invention relates to a safety device for detecting electrode breakage in an electric arc furnace in which an electrode is secured on an electrode support arm. An alarm signal for detection of electrode breakage is generated by pressure drop in a conduit, which is filled with medium under constant pressure, upon electrode breakage.

Electrical arc furnaces are used as smelting furnaces for producing in particular steel. To this end, electrical arc furnaces are filled from above, with a pivoted out cover, with scrap and other charging materials and melt the charge with an electrical arc of electrodes which project through cover the into the furnace. The electrodes are secured on electrode support arms and are adjusted in accordance with their consumption. The electrode support arms are used as electrode holders and usually conduct current and insure current flow in the electrode.

In these electrical arc furnaces, in particular in electrical arc smelting furnaces, it is unavoidable that here and there, during the operation, the current-conducting graphite electrodes break off and, as a result, a high-power electric arc is ignited between the electrode support arm and the stuck in the furnace, electrode end. This can damage the electrode support arm, which damage can be responsible for long production interruptions.

Numerous method for preventing breakage of electrodes are known according to DE 31 14 145 A1, loading of the electrodes themselves is prevented with an oscillation damper. Other methods are based on detection of system changes which are used as alarm signals.

DE 28 13 739 A1, e.g., proceeds from monitoring the flow of current through the electrode, and an alarm signal, which indicates electrode breakage, is generated when the interruption of current flow exceeds a predetermined time period.

Further, GB 2 037 549 A discloses a water-cooled electrode with pneumatic breakage safety means. Through corresponding conduits which extend axially through the electrode inner body and pass through a transition region in the end connection surface between a metal sleeve and a closing member, inert gas is brought up to the connection surface. A constant pressure is maintained, and a pressure drop serves as a signal of breakage of the closing member of the electrode. The drawback of this system consists in that conventional electrodes cannot be used, and only electrodes with conduits extending therethrough must be provided.

Proceeding from this, the object of the invention to provide a safety device for detecting an electrode breakage in which the drawbacks of the state-of-the art are overcome. In particular, an effective safety device that can be used with conventional electrodes, should be provided.

The core of the invention consists in that a conduit, which is filled with medium that undergoes a pressure drop at breakage of the electrode, is integrated not in the electrode itself but is rather arranged beneath the electrode on the electrode support arm as a separate device in form of a separate protective component. The advantage of this consists in that the existing devices can be equipped with this system.

The electrode support arm has a protective component preferably, a radiation protective plate, into which the conduit, which is subjected to pressure and which is closed at one end, is integrated. The conduit is preferably filled with air. At electrode breakage, as a result, an electric arc to the electrode support arm is produced and burns a hole in the radiation protective plate and, thus, in the pressurized conduit. The pressure drops and, in this way, produces a signal for turning off the melting energy.

According to a further development of the invention, the electrode is surrounded by a ring conduit which is not formed as a continuous conduit and which is filled with a medium and which, like the radiation protective plate, functions as a protective component. It is suggested to connect the ring with the radiation protective plate and thereby to provide a direction and conduit system in vicinity of the electrode body.

The radiation protective plate can further be connected with a spray ring for cooling the electrode body.

The safety system according to the invention permits to reliably prevent large damages to the electrode support arm and to prevent interruption of production. The damaged radiation protective plates or the damaged rings can be easily replaced or repaired at the next regular maintenance.

Further particularities and advantages of the invention will become apparent from the subclaims and the following description that explains in detail the embodiments of the invention shown in the drawings. With it, in addition to the above-mentioned combinations of features, the features themselves or in other combination are also essential parts of the invention.

Figure 2:
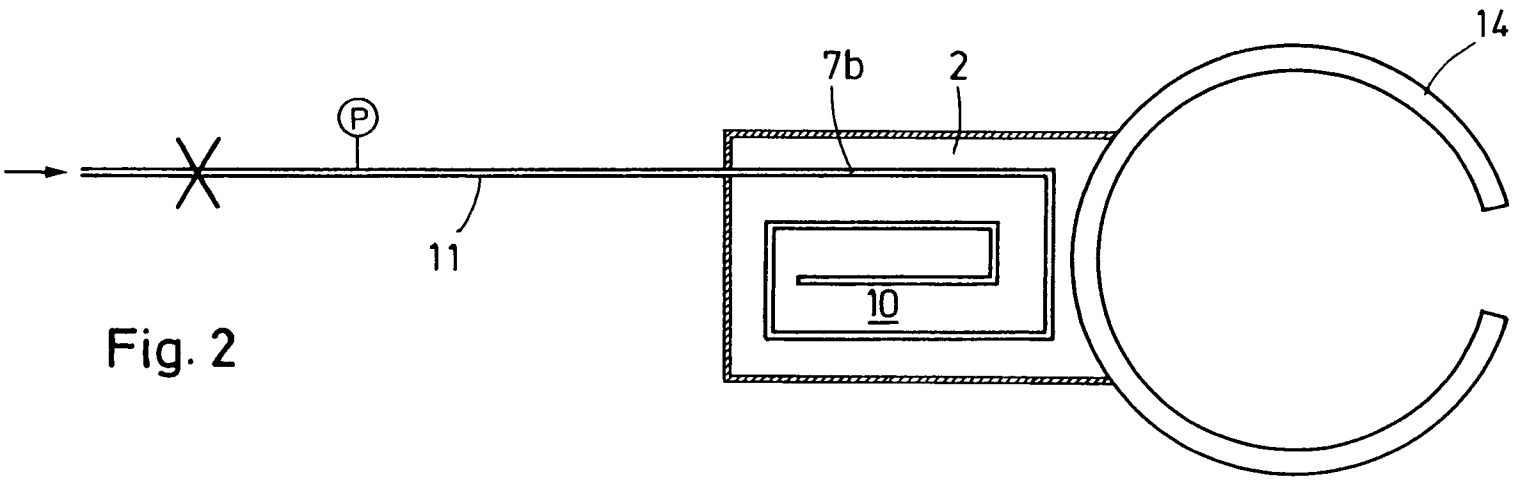
Figure 3:
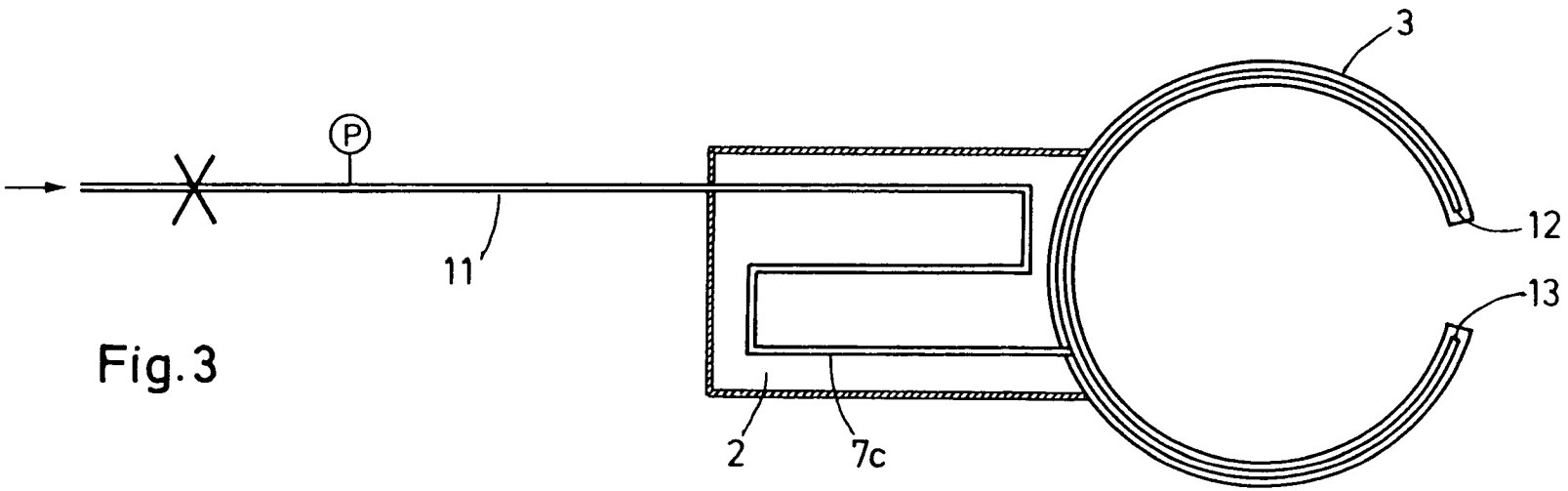
Figure 4:
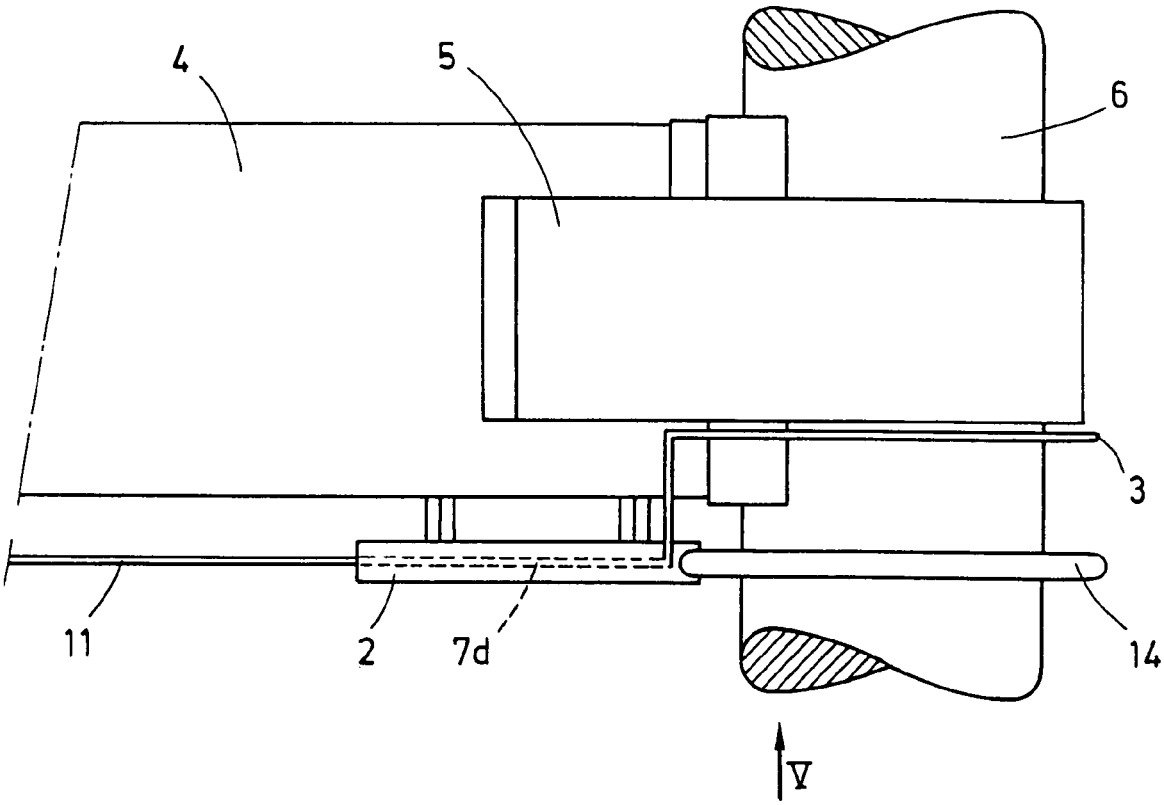

The drawings show:

FIG. 1 an electrode support arm with clamping means for an electrode and an inventive safety device with a radiation protective plate with a first conduit layout pattern;

FIG. 2 a cross-sectional view of the safety device with the radiation protective plate and a second conduit lay-out pattern;

FIG. 3 a cross-sectional view of the safety device with a protective ring provided thereon;

FIG. 4 a side view of the safety device with a spray ring; and

Figure 5:
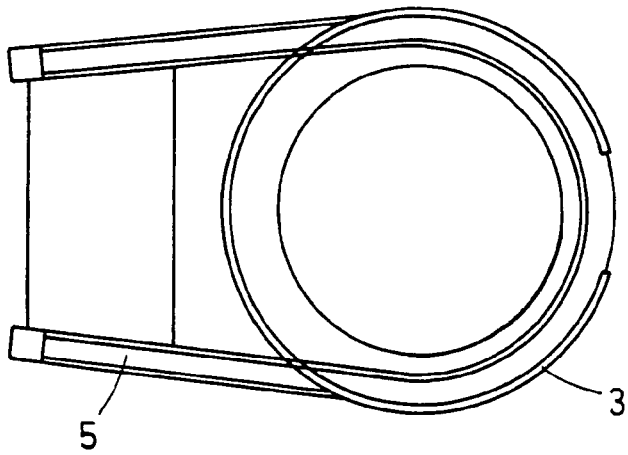

FIG. 5 a view in direction V in FIG. 4.

FIG. 1 shows a safety device 1 for detecting electrode breakage and which is formed of a radiation protective plate 2 and a spray ring 14. The radiation protective plate 2 is secured on an electrode support arm 4 that has a clamping device 5 for holding an electrode 6 (see FIG. 4). The electrode 6 is secured with a correspondingly formed contact shoe (not shown) and is supplied with current. The electrode support arm 4 projects over an electrical arc furnace, not shown here.

In the radiation protective plate 2 or in the radiation protective metal sheet, a conduit 1 of a first pattern is integrated. The conduit 7*a* has an inlet 8 and no outlet. Through the inlet 8, the tubular conduit 7*a* is supplied with air that remains under constant pressure. The tubular conduit 7*a* itself extends along a rim 9 of the radiation protective plate 2 in order to then run in the middle 10 of the plate 2 to end there.

A second conduit lay-out is shown in FIG. 2. In this embodiment, the detection conduit 7*b* is integrated in the radiation protective plate 2 and is supplied through a feeding conduit 11. The conduit 7*b* is arranged in the radiation protective plate 2 in form of a spiral. In this way, a large overlapping dimension of the conduit 7*b* with respect to the plate surface is achieved so that in case of an accident, there exists a high probability that a conduit region will be struck by an electric arc. The conduit 7*b* itself ends in the middle region 10 of the radiation protective plate 2. On the protective plate 2, a spray ring 14 is arranged.

The embodiment according to FIG. 3 shows that a tubular conduit 7*c* of the radiation protective plate 2, which is supplied with air, extends into a tubular conduit of a ring 3 arranged thereon. The conduit extends in the radiation protective plate 2 in a meandering manner and ends at both ring ends 12, 13 which are not connected with each other. The conduit as a whole is under pressure P.

FIG. 4 shows an embodiment of a conduit in which the protective plate 2 is provided with a ring 3 and a highly offset spray ring 4 arranged thereon. The ring 3 is arranged above the spray ring 14.

The safety device operates as follows. As soon as an electrode breaks, an electrical arc is formed between the break-off end of the electrode and the electrode support arm. The electrical arc burns a hole in the conduit of the radiation protective plate and/or the ring. This results in reduction of pressure, which is detected as a signal of an accident, so that the melting current can be turned off.

LIST OF REFERENCE NUMERALS

| | |
|---|---|
| 1 | Safety device |
| 2 | Radiation Protective Plate |
| 3 | Ring (annular conduit) |
| 4 | Electrode support arm |
| 5 | Clamping device |
| 6 | Electrode |
| 7a | Conduit |
| 7b | Conduit |
| 7c | Conduit |
| 8 | Conduit inlet |
| 9 | Rim region of the radiation protective plate |
| 10 | Middle region of the radiation protective plate |
| 11 | Feeding conduit |
| 12 | Ring end |
| 13 | Ring end |
| 14 | Spray ring |

The invention claimed is:

1. A safety device (1) for detecting electrode breakage in an electric arc furnace, wherein an electrode (6) is secured on an electrode support arm (4), and wherein a conduit is filled with a medium under a constant pressure and a pressure drop produced in the conduit at an electrode breakage is detected as an alarm signal, characterized in that the conduit (7*a-d*,3) is integrated in a protective component (2) of the electrode support arm (4) that is arranged beneath the electrode support arm (4) and is secured thereto, wherein in case of an electrode breakage, the conduit (7*a-d*,3) is damaged by a produced electric arc, and the pressure drop takes place.

2. A safety device according to claim 1, characterized in that the protective component comprises a radiation protective plate (2) that is arranged beneath a clamping device (5) for securing the electrode (6) on the electrode support arm (4) adjacent to the electrode (6) and into which the conduit (7*a-d*) is integrated.

3. A safety device according to claim 2, characterized in that a spray ring (14) for cooling the electrode (6) is arranged on the radiation protective plate (2).

4. A safety device according to claim 3, characterized in that the spray ring (14) is height-offset relative to the protective component ring (3).

5. A safety device according to claim 1, characterized in that the conduit (7*c*, 7*b*) is integrated in the radiation protective plate (4) in form of meander or spiral.

6. A safety device according to claim 1, characterized in that the protective component includes a ring (3) in which the conduit is integrated and which surrounds the electrode (6) at a distance therefrom.

7. A safety device according to claim 1, characterized in that the medium is air.

* * * * *